United States Patent [19]

Roccaforte et al.

[11] 4,195,765

[45] Apr. 1, 1980

[54] CARTON WITH INTEGRAL HANDLE

[75] Inventors: Harry I. Roccaforte, Western Springs; Jimmy Hanko, Evanston; Joseph F. Schillinger, Palos Hills, all of Ill.

[73] Assignee: Champion International Corporation, Stamford, Conn.

[21] Appl. No.: 960,957

[22] Filed: Nov. 15, 1978

[51] Int. Cl.[2] ..... B65D 5/46

[52] U.S. Cl. ..... 229/52 B

[58] Field of Search ..... 229/52 B, 52 BC

[56] References Cited

U.S. PATENT DOCUMENTS

| | | | |
|---|---|---|---|
| 2,693,310 | 11/1954 | Stopper | 229/52 B |
| 3,790,066 | 2/1974 | Malinowski | 229/52 B |
| 4,134,534 | 1/1979 | Scott et al. | 229/52 B |
| 4,140,267 | 2/1979 | Scott et al. | 229/52 B |

FOREIGN PATENT DOCUMENTS

| | | | |
|---|---|---|---|
| 609726 | 11/1960 | Canada | 229/52 B |
| 444017 | 2/1968 | Switzerland | 229/52 B |

*Primary Examiner*—Davis T. Moorhead

*Attorney, Agent, or Firm*—Evelyn M. Sommer

[57] ABSTRACT

The present invention relates to a carton with at least one integrally formed handle comprising first and second opposing side walls, first and second opposing end walls integrally connecting said side walls to form a generally rectangular carton and top and bottom closure panels integrally attached to said side and end walls for enclosing said carton and, in particular, an improved top closure panel comprising inner and outer wall panels attached at their outer edges to said first and second side walls respectively and to each other in superimposed relationship, first and second congruent handles formed in said inner and outer walls, respectively, in a superimposed relationship, and means attaching said first and second handles to each other to form a unitary handle selectively movable from a horizontal to a vertical position for carrying said carton.

2 Claims, 11 Drawing Figures

CARTON WITH INTEGRAL HANDLE

BACKGROUND OF THE INVENTION

Although the prior art discloses a number of cartons with integrally formed handles, such cartons cannot be processed on the equipment normally used to glue, fold, load and close the cartons that do not have handles integrally formed therein without making modifications and adjustments to said equipment. The manufacture and construction of such carton requires several steps. First, the blank is formed having the necessary side walls, end walls, bottom and top closure flaps and glue panels. The blank is then forwarded to a converter who subjects the carton blank to a gluing operation wherein the glue is applied to a proper flap and the panels folded at appropriate score lines and glued to the glue flap to form a substantially rectangular carton which is in its flat folded condition for transmission to the user thereof. The converter may also wish to print desired labels and instructions on the outside of the carton blank as required by the user prior to the gluing and folding operation.

At the user's plant, the folded, substantially rectangular carton is applied to a standard vertically loaded, seal and gluer machine. This machine folds the bottom side panels, and glues the two major bottom flaps to the bottom side panels. Next, the carton is filled with the product through the top opening and then the two top end flaps and top major flaps are folded and glued to each other to seal the carton. When it is desired to vertically load, seal and glue a carton of the type having an integrally formed handle in the top thereof, these machines must be adjusted or modified in order to perform the desired function inasmuch as the carton blank no longer has just two top end flaps and two top major flaps overlapping said end flaps. There has to be another flap in which the handle is formed arranged with the top end flaps and top major flaps.

The present invention is an improvement on the construction taught in the prior art by providing a carton with an integral handle that can be loaded, sealed and glued by the user thereof without any machine adjustment or modification.

SUMMARY OF THE INVENTION

The present invention overcomes the problem of the prior art and provides cartons with integral handles that can be produced in a rapid, efficient and economical manner by enabling the user thereof to load, seal and glue the carton with his normal machines without any adjustment or modification thereof.

Briefly stated, the invention relates to a carton with at least one integrally formed handle comprising first and second opposing side walls, first and second opposing end walls hingedly connecting said side walls to form a generally rectangular carton and top and bottom closure panels hingedly attached to said side and end walls for enclosing said carton, and, in particular, an improved top closure panel comprising inner and outer wall panels attached at their outer edges to said first and second side walls, respectively, and to each other in superimposed relationship, first and second congruent handles formed in said inner and outer walls, respectively, in a superimposed relationship and means attaching said first and second handles to each other to form a unitary handle selectively movable from a horizontal to a vertical position for carrying said carton.

The invention further relates to a carton blank for forming a carton with at least integral handle comprising: first and second side walls, a first end wall hingedly connecting said first and second side walls, a second end wall hingedly attached to the outer edge of said second side wall, a glue flap hingedly attached to the outer edge of said first side wall whereby when said walls and flap are folded about said hinge lines, a generally rectangular carton is formed with said glue flap located against and glued to the inner side of said second end wall, bottom closure flaps hingedly attached to said side and end walls for forming a bottom of said carton when folded about said hinge lines and glued to each other, first and second flaps hingedly connected to the top of said opposing end walls, respectively, an extended glue flap hingedly connected to the top of said first side wall, an inner flap hingedly connected to the remaining edge of said extended glue flap whereby said inner flap may be folded over and attached to one side of said extended glue flap to strengthen said inner flap, said inner flap having integrally formed therein in the plane thereof a first carton handle, said first handle being generally "U-shaped" with the base thereof located in a direction toward said extended glue flap, said base being hingedly attached to said inner flap, said first handle being removably attached to said inner wall at predetermined points on the remaining periphery thereof, whereby said first handle may be pivotally moved about its base from a horizontal to a vertical position, and an outer flap hingedly connected to the top of said second side wall and having integrally formed therein in the plane thereof, a second carton handle, said second carton handle being generally "U-shaped" with the base thereof located in a direction toward said second side wall, said base being hingedly attached to said outer flap, whereby when said generally rectangular carton is formed, said inner flap with the extended glue flap attached thereunder, is interposed between, and attached to, said outer flap and said first and second flaps with said second handle being congruent with, and attached to, said first handle to form a unitary handle selectively movable from a horizontal to a vertical position for carrying said carton.

BRIEF DESCRIPTION OF THE DRAWINGS

These and other objects and advantages of the present invention will be disclosed in the course of the following specification, reference being had to the accompanying drawings in which.

DESCRIPTION OF THE PREFERRED EMBODIMENT

The carton with an integrally formed handle of the present invention comprises first and second opposing side walls, first and second opposing end walls hingedly connecting the side walls to form a generally rectangular carton and top and bottom closure panels hingedly attached to the side and end walls for enclosing the carton and has an improved top closure panel comprising inner and outer wall panels attached at their outer edges to said first and second side walls, respectively, and to each other in superimposed relationship, first and second congruent handles formed in said inner and outer walls, respectively, in a superimposed relationship and means attaching said first and second handles to each other to form a unitary handle selectively movable from a horizontal to a vertical position for carrying said carton and its contents.

Figure 1:
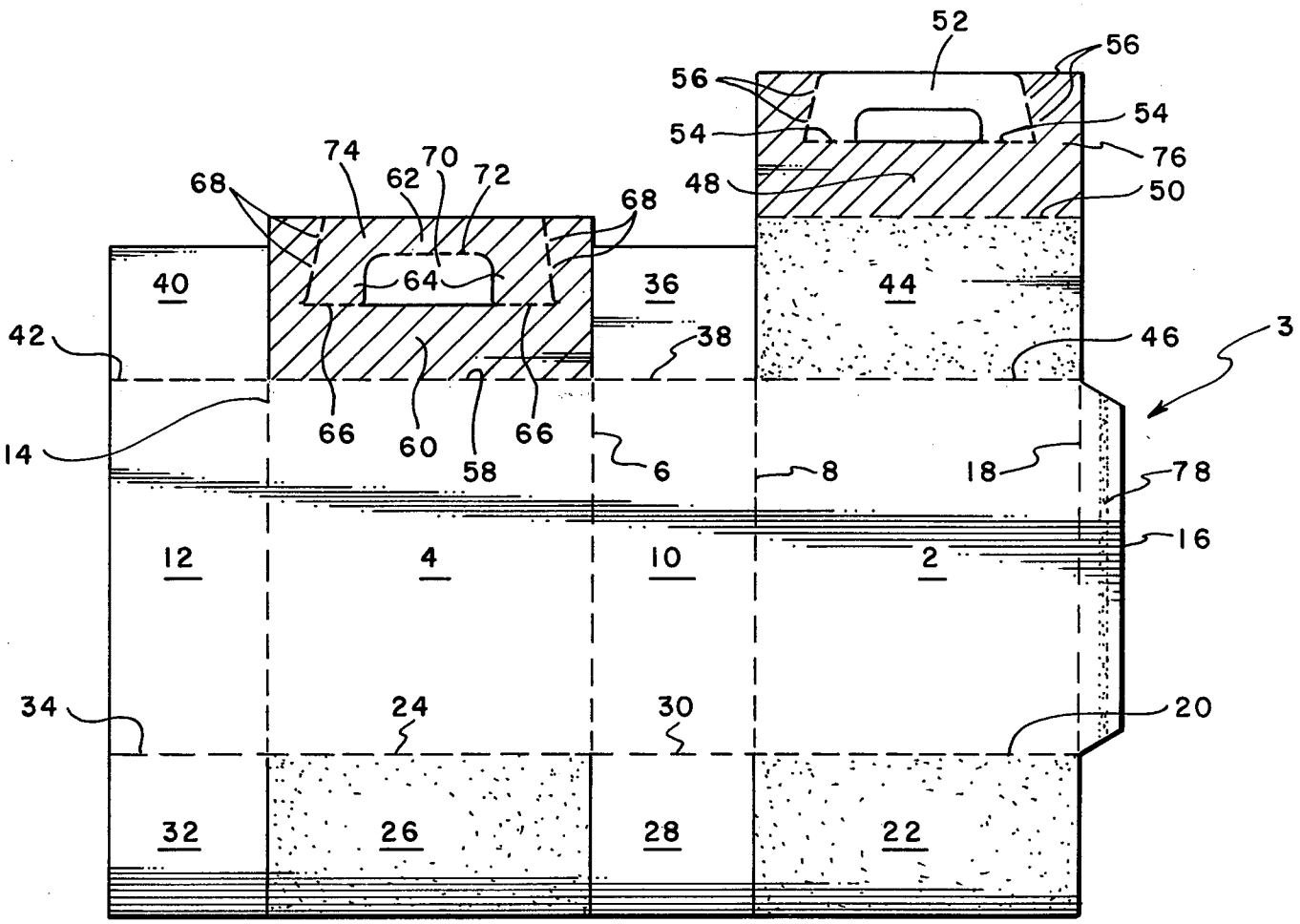
FIG. 1 is a plan view of a carton blank incorporating an integrally formed handle in accordance with the present invention.

FIG. 1 is a plan view of a carton blank incorporating an integrally formed handle in accordance with the present invention. Blank 3 generally comprises first side wall 2 and second side wall 4 hingedly connected at score lines 6 and 8 with end wall panel 10. End wall panel 12 is connected to the other edge of side wall panel 4 at hinge line 14. A glue tab 16 is hingedly attached to first side wall panel 2 at articulation 18.

Figure 4:
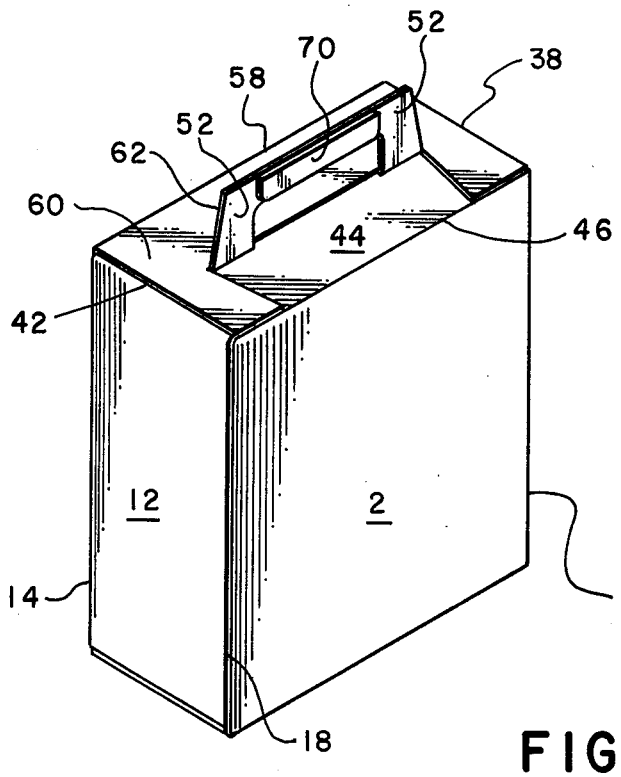
FIG. 4 is a perspective view of the carton blank in its erected form with the integral handle in its vertical position ready for carrying said carton and its contents.

To form the bottom of the carton, side wall panel 2 has attached thereto at score line 20, major flap 22 and side wall panel 4 has attached thereto at score line 24, major flap 26. End wall 10 has attached thereto bottom closure flap 28 at score line 30 and end wall panel 12 has attached thereto bottom closure flap 32 at hinge line 34. Also attached to the top of end wall panel 10 is top closure flap 36 hingedly connected thereto at score line 38. End wall panel 12 has attached to the top thereof top closure flap 40 hingedly connected at score line 42. Extended glue flap 44 is hingedly connected at score line 46 to the top of first side wall 2. Inner flap 48 is hingedly connected at articulation 50 to the remaining edge of said extended glue flap 44 and has integrally formed therein in the plane thereof, a first carton handle 52 which is generally "U-shaped" in form with the base thereof being hingedly attached at 54 to said inner flap 48. It will be noted that the base 54 of handle 52 is located in inner flap 48 in a direction toward said extended glue flap 44. Handle 52 is removably attached to inner flap 48 at predetermined points 56 which are nicks or slight interruptions in the line of cut defining the periphery of said handle 52. Thus, after the carton blank has been folded and tubed to form the carton of generally rectangular construction, handle 52 may be pivoted to a vertical position about base 54 by pulling on the upper part thereof, thus rupturing nicks 56 and allowing the handle to assume its vertical position as shown in FIG. 4.

Hingedly connected to the top edge 58 of second side wall panel 4 is an outer flap 60 having integrally formed therein, the plane thereof, a second carton handle 62. Second handle 62 is generally "U-shaped" in form with the base 64 thereof located in a direction toward second side wall 4, said base being hingedly attached to outer flap 60 at score line 66. Again, second handle 62 is held in place by slight interruptions or nicks 68. Inner panel 70 of handle 62 is completely severed from outer flap 60 except at its top which is hingedly connected to the inner top of said handle at score line 72. Shaded area 74 on outer panel 60 and shaded area 76 on inner panel 48 represent gluing areas used when erecting the carton as will be disclosed later. Further, strip 78 on the back side of glue tab 16 represents the area in which glue is applied prior to folding and tubing the carton.

The carton blank as shown in FIG. 1 is the end result of the manufacturing stage. This blank is then transmitted to the converter facility where the next step in the operation is performed. At the converter facility, the carton blank has certain operations performed thereon to prepare it to be shipped to the user thereof for final sealing and closing thereof. The converter operation so arranges the carton that, when it is shipped to the user, the standard, vertically loaded, seal and gluer machine can perform its necessary operations without adjustments or modifications.

Figure 5:
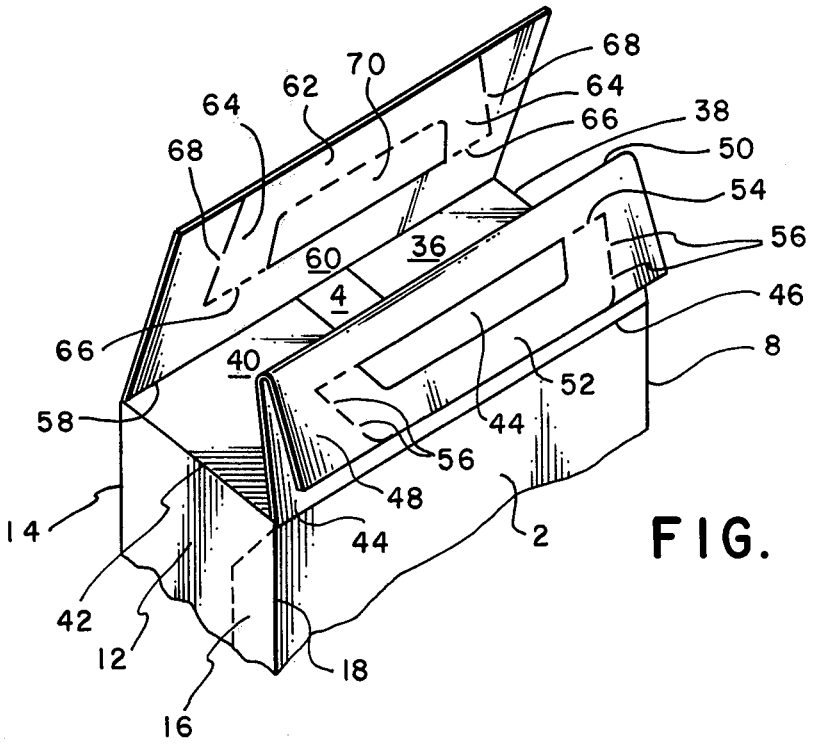
FIG. 5 is a fragmentary isometric view of the novel carton illustrating the manner in which the inner panel, outer panel and glue flap relate to each other as the top of the carton is folded.
Figure 2:
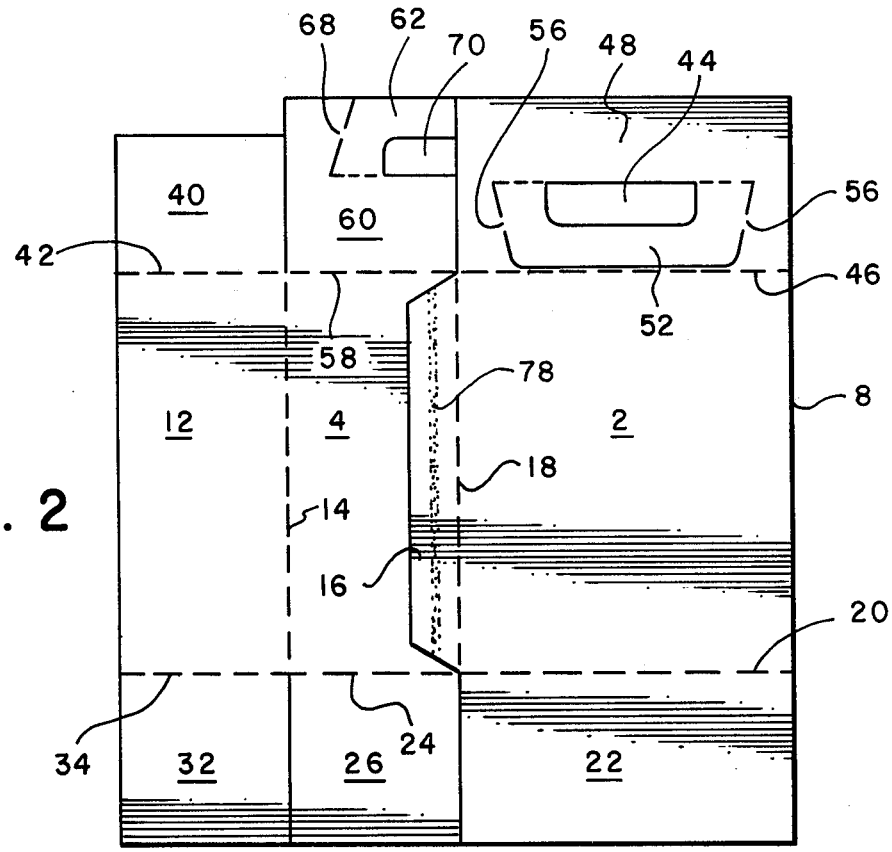
FIG. 2 is a plan view of the partially folded blank.

Thus, the converter may print on the outside of the blank shown in FIG. 1 any pattern, design, or other information required by the user. FIG. 1 shows the inside of the carton blank 3 and thus, any printing would take place on the opposite side thereof. After the printing operation is completed, the converter applies glue strip 78 on the back of glue tab 16. Side wall 2 and related major bottom closure flap 22, inner flap or panel 48 and associated glue flap 44 and glue tab 16 are all folded about score line 8 to overlap end wall panels 10 and partially overlap side wall panel 4 and its associated outer flap 60 and major bottom closure flap 26. Inner flap 48 is folded and glued to panel 44 except for handle 52. FIG. 5 more clearly shows how inner flap or panel 48 is folded over and relates to glue panel 44. Glue had been previously applied to glue tab 16 along strip 78 and now end wall panel 12 may be glued to glue tab 16 by folding end wall panel 12 to the right about score ling 14 in FIG. 2 and the resulting tubed and folded carton blank is shown in FIG. 3.

Figure 3:
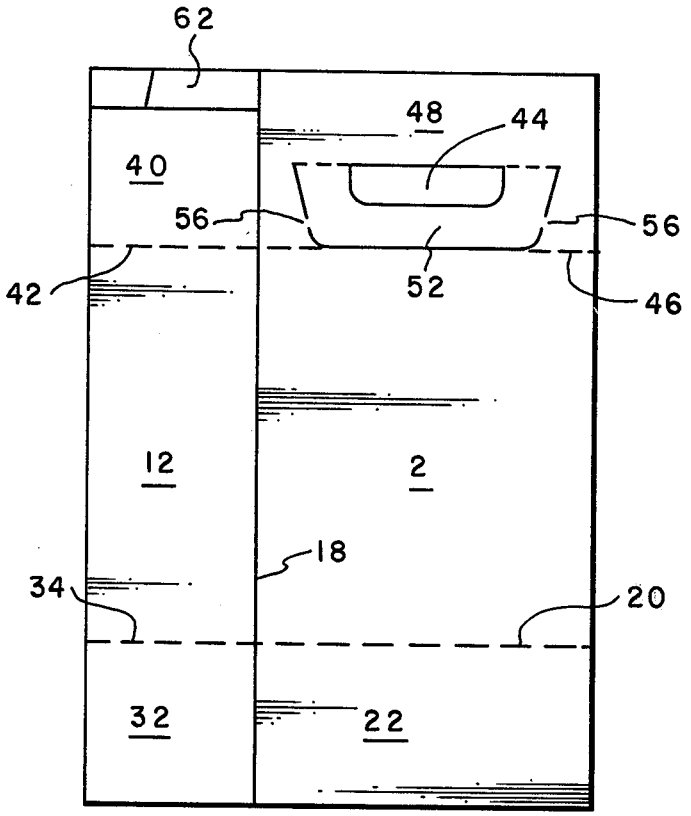
FIG. 3 is a plan view of the folded and tubed blank.

The folded and tubed carton shown in FIG. 3 is now ready for the user thereof who needs merely to fold and glue bottom closure flaps 22, 26, 28, and 32, fill the carton with the contents and then fold top closure panels 36, 40, 60 and inner panel 48 with glue flap 44 glued thereto. The resultant carton is shown in FIG. 4.

The folded and tubed carton as shown in FIG. 3 can be processed by the user thereof with standard equipment for loading, sealing, gluing and folding the carton to its final shape even though there is integrally formed therein a handle which may be used to carry the carton and its contents. The standard cartoning equipment used to load, seal, glue and fold the carton to its final state performs the following steps:

First, it folds the bottom side flaps 28 and 32 and then folds the two major bottom flaps 22 and 26 over the bottom side panels and glues them thereto to form the bottom closure of the carton.

Secondly, the machine fills the carton with the product through the top opening.

Thirdly, it folds the two top side flaps 36 and 40 inwardly then glues combined inner flap or panel 48 and glue flap 44 to side flaps 36 and 40, and then folds outer flap or panel 60 over inner flap 48 and glues it thereto with handles 52 and 62 being congruent and superimposed on each other. The carton is then packaged and shipped for distribution to the consumer who, when it is necessary to carry the carton, simply lifts glued handles 52 and 62 up about hinge lines 54 and 66 to a vertical position as shown in FIG. 4.

The novel carton having a carrying handle integrally formed therein can be preprocessed to enable it to be loaded and sealed on the user's regular cartoning equipment without any adjustments or modifications thereof. It will be understood that such cartons are considerably more economical to use because no adjustments or modifications to the regular cartoning equipment are necessary, and, thus, the cartons can be processed much more quickly, thus, resulting in a considerable savings to the user thereof.

Not only does the novel carton provide a savings in both time and cost, but as can be seen in FIG. 5, an improved and strengthened top closure panel is provided. First, glue flap or reinforcing panel 44 adheres to and completely covers top closure panels 36 and 40 and the space therebetween. With panels 44, 48 and 60 all glued together and, in addition, glued to top closure flaps 36 and 40, the top closure panel is relatively strong having a four-ply thickness.

The carton can be formed of any conventional paper or board stock dependent upon the performance desired of the carton.

FIG. 6 through FIG. 10 illustrate an alternate embodiment of the novel carton with integrally formed handle.

Figure 6:
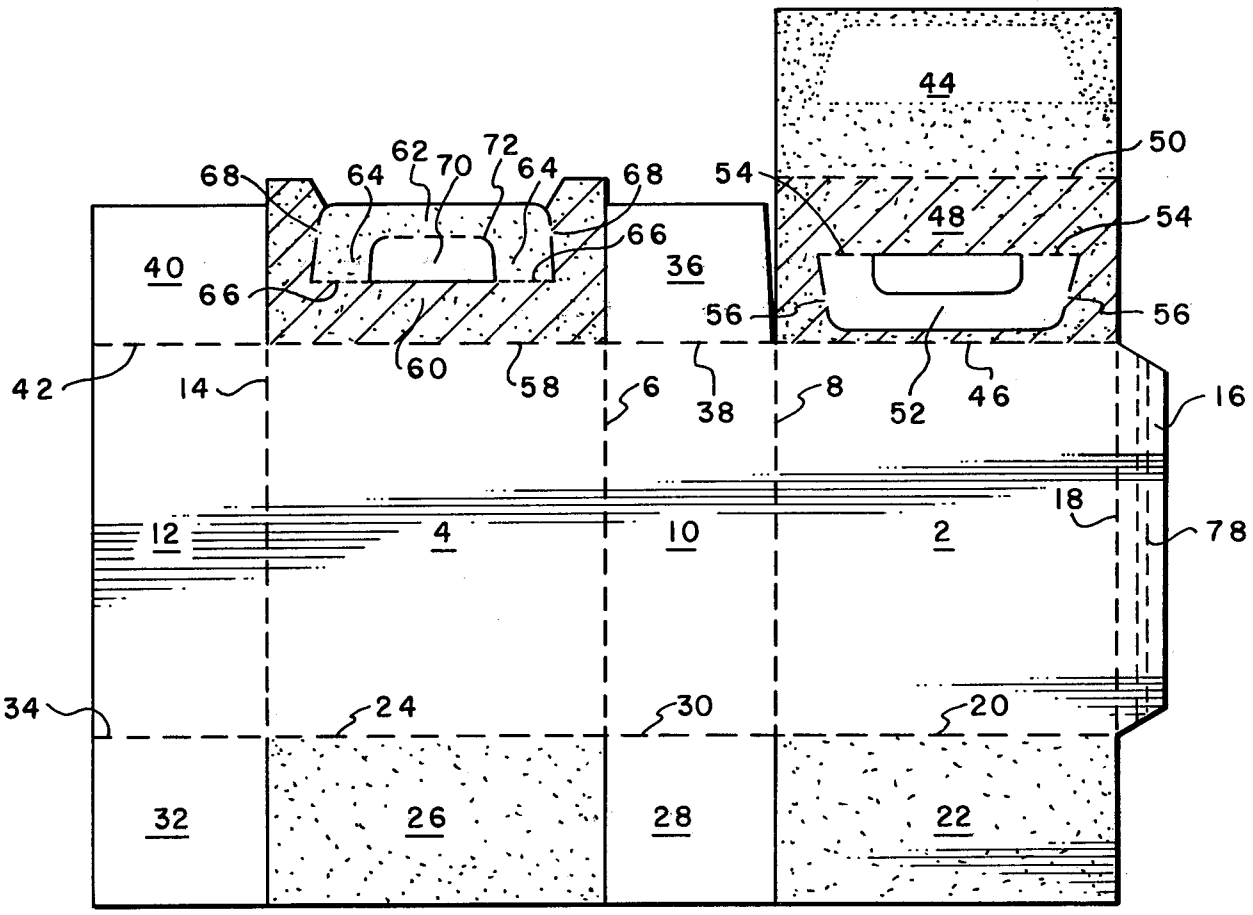
FIG. 6 is a plan view of an alternate embodiment of a carton blank incorporating an integral carrying handle in accordance with the present invention.

FIG. 6 is a plan view of the blank from which the carton of the alternate embodiment is formed. The blank comprises first and second side walls 2 and 4, respectively, a first end wall 10 hingedly connecting said first and second side walls at 6 and 8 respectively. A second end wall 12 is hingedly attached at 14 to the outer edge of the second side wall 4. A glue tab 16 is hingedly attached at 18 to the outer edge of first side wall 2 and has glue strip 78 thereon. Bottom closure flaps 22 and 26 are attached to side walls 2 and 4, respectively, at hinge lines 20 and 24, respectively. Further, major bottom closure flaps 28 and 32 are hingedly attached to end walls 10 and 12, respectively, at hinge lines 30 and 34, respectively. First and second top closure flaps 36 and 40 are hingedly connected to the top of opposing end walls 10 and 12, respectively, at hinge lines 38 and 42, respectively. Inner flap 48 is hingedly connected at 46 to the top of first side wall 2 and has integrally formed therein in the plane thereof a first carton handle 52, which is generally "U-shaped" with the base thereof located in a direction away from first side wall 2, said base being hingedly attached to inner flap 48 at hinge lines 54. First handle 52 is removably attached to inner flap at predetermined points or nicks 56 on the remaining periphery of the cut line forming handle 52, whereby handle 52 may be pivotally moved from a horizontal position to a vertical position by rupturing nicks 56 and pivoting handle 52 about base hinge lines 54. Extended glue flap or reinforcing panel 44 is hingedly attached to inner flap 48 at hinge line 50 and extends outwardly from inner flap 48 whereby glue flap 44 may be folded under and one side thereof glued to inner flap 48 as a reinforcing panel to strengthen said inner flap 48.

Outer flap 60 is hingedly connected at hinge line 58 to the top of second side wall 4 and has integrally formed therein in the plane thereof a second carton handle 62. The second carton handle 62 is generally "U-shaped" with the base 66 thereof located in a direction toward second side wall 4. Second handle 62 is hingedly attached at base 66 to outer flap 60 whereby when a generally rectangular carton is formed from said blank, inner flap 48, with extended glue flap 44 attached thereunder, is interposed between and attached to outer flap 60 and first and second top closure flaps 36 and 40 with second handle 62 being congruent with and attached to first handle 52 form a unitary handle selectively movable from a horizontal to a vertical position for carrying the carton.

Figure 7:
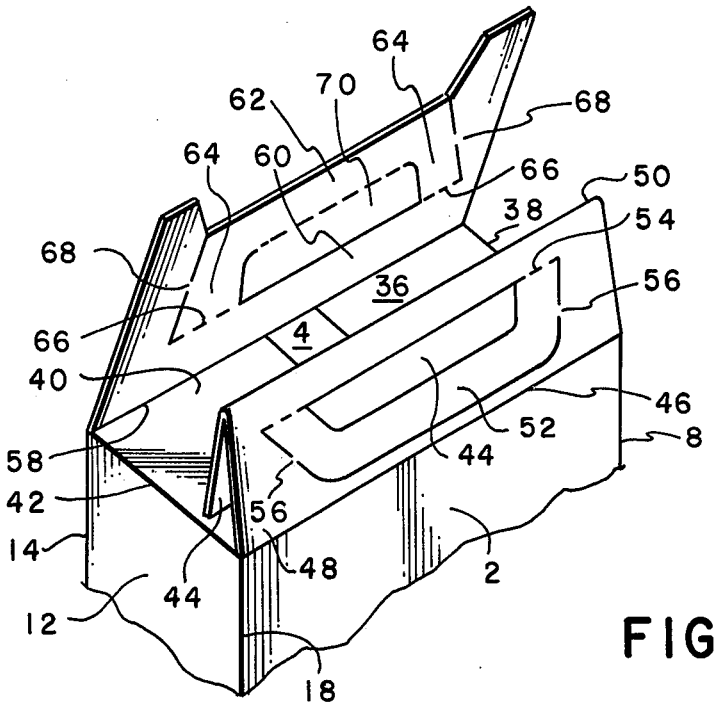
FIG. 7 is a fragmentary isometric view of an alternate embodiment of the novel carton illustrating the manner in which the inner panel, outer panel and glue flap relate to each other as the top of the carton is folded.

FIG. 7 is a fragmentary perspective view of the top closure panel of the novel carton illustrating the manner in which the respective parts, or components, relate with each other. As can be seen in FIG. 7, top closure panels 36 and 40 are folded inwardly about hinge lines 38 and 42, respectively. Extended glue flap or reinforcing panel 44 is folded inwardly and under inner flap 48 about hinge line 50 and is glued thereto except for handle 52. The resulting double thickness panel with extended glue flap 44 on the bottom and first handle 52 on the top thereof, is folded about score line 46 and glued to top closure panels 36 and 40.

Figure 10:
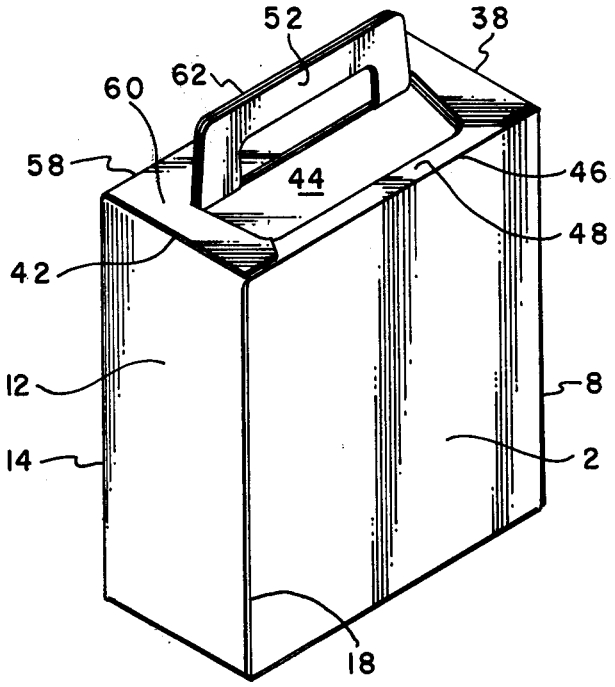
FIG. 10 is a perspective of the erected carton blank of the second embodiment showing the integrally formed carrying handle in its vertical position for carrying said carton and its contents.

Outer flap 60 is then folded inwardly about hinge line 58 and overlaps and is glued to the top of inner flap 48. In this position, first handle 52 is immediately under, and congruent with, second handle 62. First handle 52 and second handle 62 are glued together in this position to form a unitary handle selectively movable from a horizontal to a vertical position as shown in FIG. 10.

Figure 8:
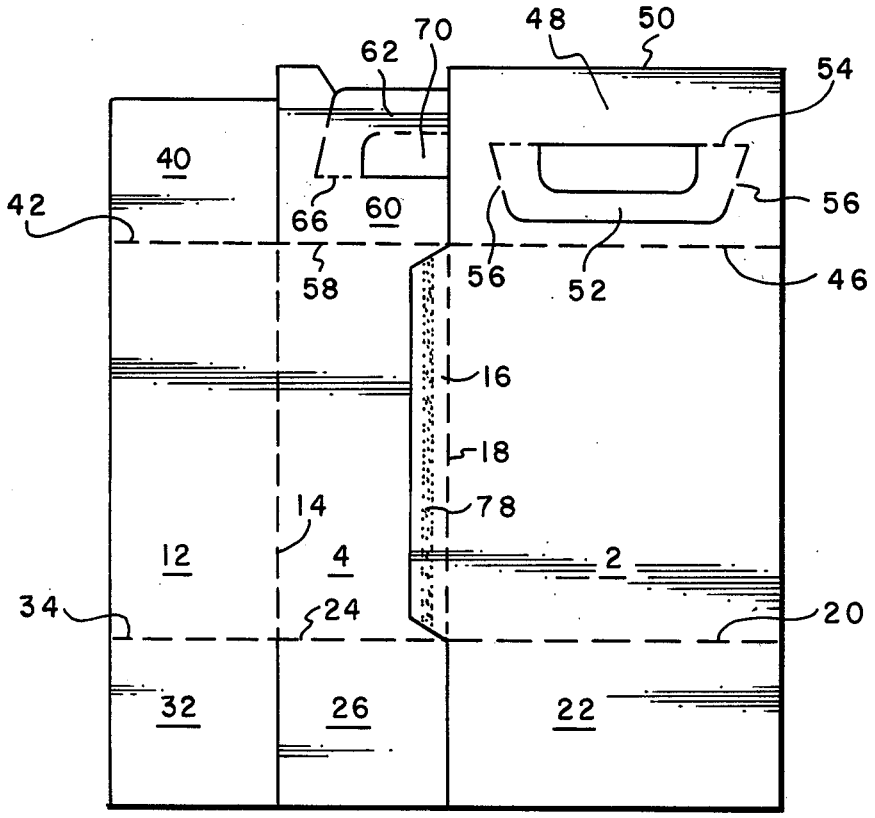
FIG. 8 is a plan view of a partially folded blank of the alternate embodiment disclosed herein.

In order to fold and tube the carton and prepare it for the user as shown in FIG. 8, the converter first folds extended glue flap 44 under and glues it to inner panel 48. Side wall 2 with its bottom closure panel 22 and inner panel 48 (with extended glue flap 44 attached thereto) is folded to the left as shown in FIG. 8 about score line 8 to obtain the partial fold as shown in FIG. 8. As shown in FIG. 8, side wall panel 2 overlaps end wall panel 10 and partially overlaps side wall panel 4. The converter has already applied glue along strip 78 on glue tab 16 and then folds end panel 12 and associated top and bottom closure flaps 32 and 40, respectively, about hinge line 14 to the right as shown in FIG. 8 and is glued to glue tab 16. The resultant tubed and folded carton is shown in FIG. 9.

Figure 9:
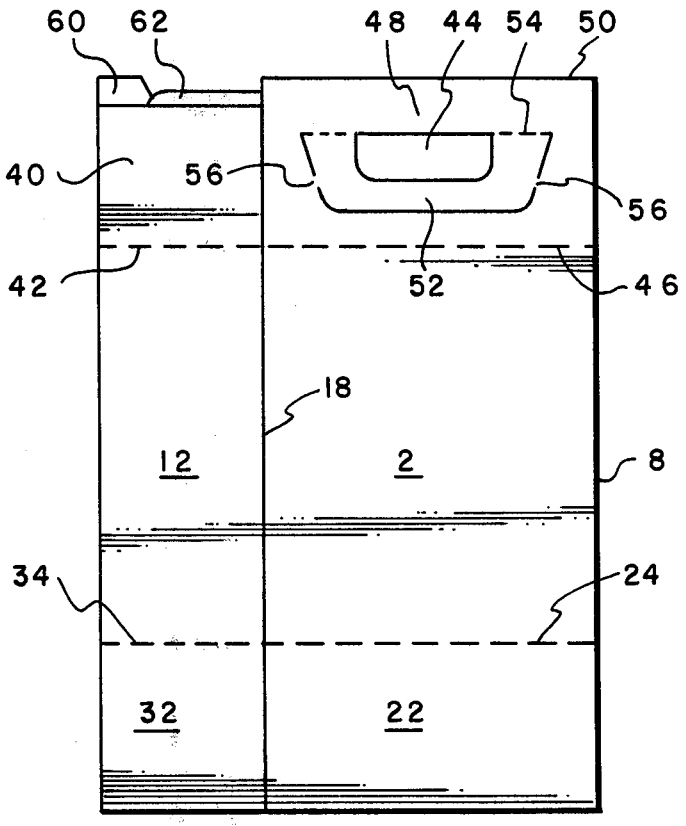
FIG. 9 is a plan view of the folded and tubed blank of the alternate embodiment.

The tubed and folded carton shown in FIG. 9 can then be sent directly to the user of the carton who can use the carton blank on their standard cartoning equipment to fold bottom closure flaps 28 and 32 about hinge lines 30 and 34 and then fold the two major bottom closure flaps 22 and 26 over flaps 28 and 32 and glue them together. The machine next fills the carton with the product through the top opening and then folds the two side flaps 36 and 40 inwardly. Combined inner flap 48 and extended glue panel 44 is then folded inwardly and glued to panels 36 and 40. As the last stage of the process, outer panel 60 is folded about hinge line 58 over inner panel 48 and glued thereto with handles 52 and 62 in a superimposed congruent relationship. The completed carton and contents are shipped for distribution to the ultimate consumer thereof. When the consumer desires to carry the package, combined handles 52 and 62 are simply raised from the horizontal position to the vertical position by rupturing nicks or interruptions 56 and pivoting the glued handles about their corresponding base lines 54 and 66 to a vertical position as shown in FIG. 10.

Again, as can be seen in this embodiment, a strengthened and improved top closure panel is formed with the added strength of reinforcing panel 44 and the required utility and, yet, can be used on the standard cartoning equipment without modification or adjustment, thereby saving both time and cost.

Figure 11:
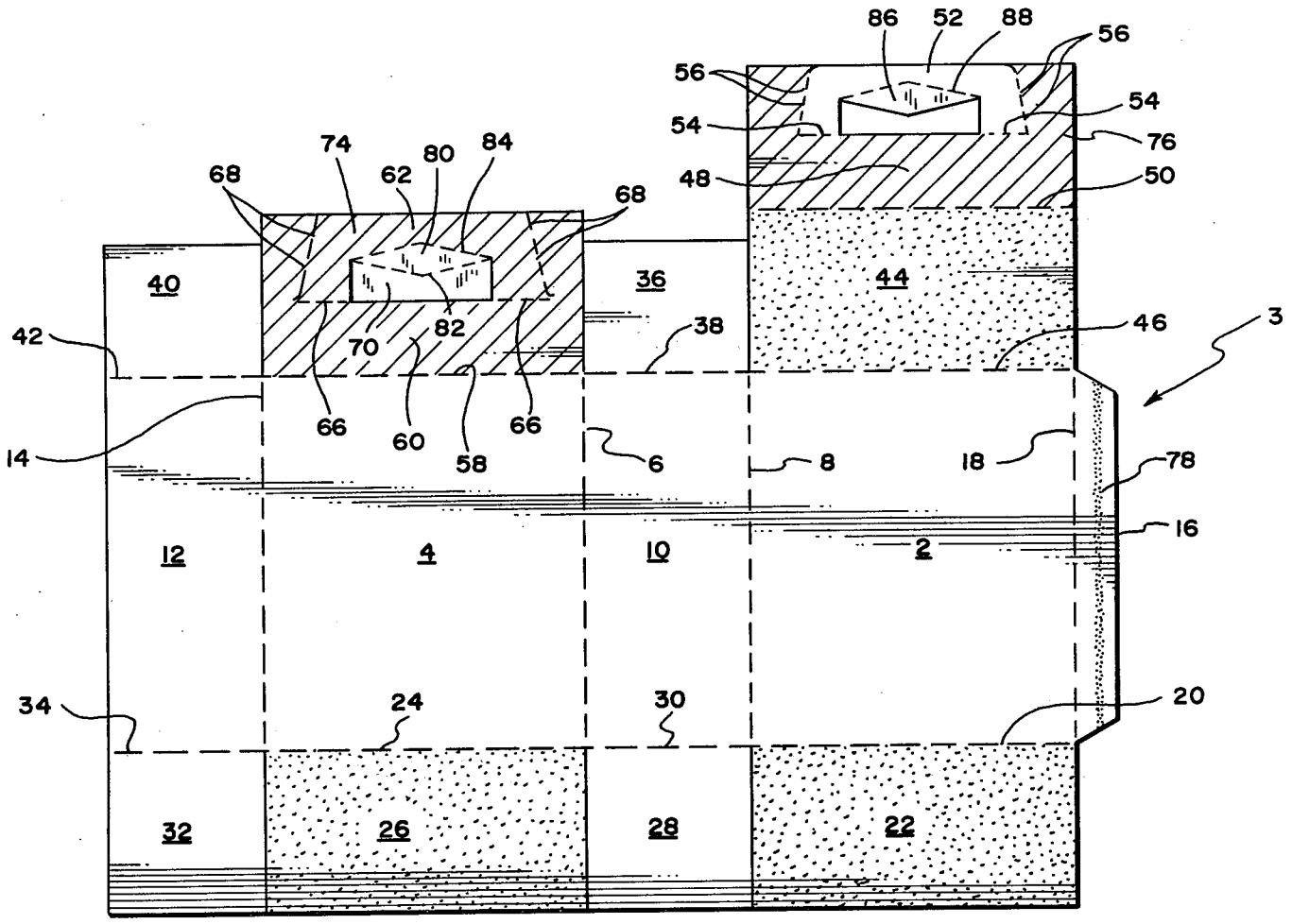
FIG. 11 is a plan view of a carton blank illustrating an alternate handle embodiment.

It will be understood that inner portion 70 of handle 62 in FIG. 1 and FIG. 6 folds under handle portions 52 and 62 180° as shown in FIG. 4 to produce a rounded edge for protection of the fingers while the carton is being carried. However, it can still cut or hurt the fingers where the product carried in the carton is heavy. Thus an alternative handle design may be used as shown in FIG. 11 to eliminate the problem. FIG. 11 illustrates the modified outer flap 60, reinforcing panel 44 and modified inner flap 48 shown in FIG. 1. Modified outer flap 60 again has an inner portion 70. However, in this embodiment, inner portion 70 is integrally formed with and hingedly attached to a first diamond shaped panel 80 by means of score lines 82. First diamond shaped panel 80 is integrally formed with and hingedly attached to handle 62 by score line 84. In like manner, handle 52, shown in FIG. 11, has a second diamond shaped panel 86 integrally formed with and hingedly attached to the inner, top portion thereof by score lines 88. When handles 52 and 62 overlap and are glued as shown in FIG. 4, FIG. 5, FIG. 7, and FIG. 10, first and second diamond shaped panels 80 and 86 overlap in a congruent relationship and are glued together. When inner handle portion 70 is pushed through the inner opening of handle 52 as shown in FIG. 4, first and second diamond shaped panels 80 and 86 fold about score lines 84 and 88 respectively and allow the fingers to rest on a wider and thicker area in the shape of the diamond panels 80 and 86 thus protecting the fingers. Obviously, the embodiment shown and illustrated in FIG. 6 through FIG. 10 could also be modified in like manner to provide a handle with a wider and thicker area in the shape of a substantially horizontal diamond panel to protect the fingers.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. In a carton with integrally formed handle comprising first and second opposing side walls, first and second opposing end walls hingedly connecting said side walls to form a generally rectangular carton and top and bottom closure panels hingedly attached to said side and end walls for enclosing said carton, an improved top closure panel comprising:

(a) an inner wall hingedly attached to said first side wall and having integrally formed in the plane thereof a first carton handle,
  (i) said first handle being hingedly attached to said inner wall at its base and
  (ii) removably attached to said inner wall at predetermined points on the remaining periphery thereof whereby said first handle may be pivotally moved from a horizontal to a vertical position,
(b) an outer wall hingedly attached to said second side wall in superimposed relationship with said inner wall and having integrally formed therein in the plane thereof, a second carton handle,
  (i) said second handle being hingedly attached to said outer wall at its base and
  (ii) removably attached to said outer wall at predetermined points on the remaining periphery of said second handle, whereby said second handle may be pivotally moved about its base from a horizontal to a vertical position,
(c) means attaching said inner panel to said outer panel in said superimposed relationship whereby said second handle is congruent with and attached to said first handle to form a unitary handle selectively movable from a horizontal to a vertical position for carrying said carton,
(d) a first diamond shaped panel integrally formed with and hingedly attached to the inner top of said first handle,
(e) an inner rectangular panel integrally formed with and hingedly attached to the remaining edges of said first diamond shaped panel for folding under said first and second handles, and
(f) a second diamond shaped panel integrally formed with and hingedly attached to the inner top of said second handle whereby said first and second diamond shaped panels are congruent and overlapping when said first and second handles are congruent and overlapping, said folded, inner rectangular panel and said congruent diamond shaped panels folded about said hinges attaching them to said first and second handles respectively, thereby produce a substantially horizontal diamond panel for protecting the fingers when said carton is carried.

2. In a carton with integrally formed handle comprising first and second opposing side walls, first and second opposing end walls hingedly connecting said side walls to form a generally rectangular carton and top and bottom closure panels hingedly attached to said side and end wall for enclosing said carton, an improved top closure panel comprising:

(a) inner and outer wall panels attached at their outer edges to said first and second side walls, respectively, and to each other in superimposed relationship,
(b) first and second congruent handles formed in said inner and outer wall panels, respectively, in a superimposed relationship,
(c) means attaching said first and second handles to each other to form a unitary handle selectively movable from a horizontal to a vertical position for carrying said carton,
(d) a first diamond shaped panel integrally formed with and hingedly attached to the inner top of said first handle,
(e) an inner rectangular panel integrally formed with and hingedly attached to the remaining edges of said first diamond shaped panel for folding under said first and second handles, and
(f) a second diamond shaped panel integrally formed with and hingedly attached to the inner top of said second handle whereby said first and second diamond shaped panels are congruent and overlapping when said first and second handles are congruent and overlapping, said folded, inner rectangular panel and said congruent diamond shaped panels folded about said hinges attaching them to said first and second handles respectively, thereby produce a substantially horizontal diamond shaped panel for protecting the fingers when said carton is carried.

* * * * *